US005922524A

United States Patent [19]

Büscher et al.

[11] Patent Number: 5,922,524

[45] Date of Patent: Jul. 13, 1999

[54] COLOUR PHOTOGRAPHIC RECORDING MATERIAL

[75] Inventors: Ralf Büscher, Lohmar; Peter Bell, Köln; Hans-Ulrich Borst, Elsdorf; Jörg Siegel, Leverkusen; Johannes Willsau, Leverkusen; Heinrich Odenwälder, Leverkusen, all of Germany

[73] Assignee: Agfa-Gevaert AG, Germany

[21] Appl. No.: 08/794,098

[22] Filed: Feb. 3, 1997

[30] Foreign Application Priority Data

Feb. 9, 1996 [DE] Germany ..... 19604743

[51] Int. Cl.[6] ..... G03C 1/08; G03C 7/26; G03C 7/32

[52] U.S. Cl. ..... 430/543; 430/549; 430/598; 430/955; 430/505

[58] Field of Search ..... 430/543, 505, 430/598, 935, 549

[56] References Cited

U.S. PATENT DOCUMENTS

| | | | |
|---|---|---|---|
| 4,618,572 | 10/1986 | Mihayashi et al. | 430/598 |
| 4,656,123 | 4/1987 | Mihayashi et al. | 430/598 |
| 4,746,601 | 5/1988 | Mihayashi et al. | 430/598 |
| 4,948,712 | 8/1990 | Inoue et al. | 430/598 |
| 4,994,358 | 2/1991 | Deguchi et al. | 430/598 |
| 5,213,942 | 5/1993 | Deguchi et al. | 430/598 |
| 5,306,603 | 4/1994 | Mihayashi | 430/549 |

FOREIGN PATENT DOCUMENTS 272 530 10/1989 Germany .

*Primary Examiner*—Geraldine Letscher
*Attorney, Agent, or Firm*—Connolly & Hutz

[57] ABSTRACT

A colour photographic recording material having camera sensitivity, possessing on a transparent support at least one silver halide emulsion layer unit which is sensitive to part of the visible spectrum and consists of at least the following constituent layers:

a) a spectrally sensitised silver halide emulsion layer containing an effective quantity of a FAR coupler (coupler, which during coupling releases groups producing fogging nuclei) and optionally a colour coupler, the latter during the colour development process coupling with a dye of which the colour is complementary to the spectral sensitisation of layer a), and b) a fine-grained silver halide emulsion layer having low light-sensitivity, of which the silver halide grains are not spectrally sensitised, being a layer adjacent to layer a), with layer b) containing a colour coupler which during the colour development process couples with a dye of which the colour is complementary to the spectral sensitisation of layer a) and the molar quantity of colour couplers in layer b) being greater than in layer a), is distinguished by improved graininess at higher sensitivity.

12 Claims, No Drawings

COLOUR PHOTOGRAPHIC RECORDING MATERIAL

The invention relates to a colour photographic recording material having camera sensitivity, which is distinguished by improved graininess at higher sensitivity.

From DD 272 530 it is known that colour photographic films having improved sensitivity are produced by providing, for all parts of the visible spectrum, at least one less sensitive layer and one more highly sensitive layer, by arranging the more highly sensitive layers between fine-grained silver halide emulsion layers having low light-sensitivity, by the less sensitive layers each being adjacent to at least one fine-grained silver halide emulsion layer having low light-sensitivity and by at least one more highly sensitive layer containing a DAR coupler. DAR (Developer Accelerator Releasing) couplers can be those of the kind of which the released groups intensify the development, without new developer nuclei being formed, and which are also referred to as AR (Amplifier Releasing) couplers, or of the kind of which the released groups form fogging nuclei, and which are also referred to as FAR (Fogging Agent Releasing) couplers.

According to DD 272 530, FAR couplers are included in the more red-sensitive and blue-sensitive layers in order that, together with the fine-grained silver halide emulsion layers having low light-sensitivity, they may bring about a high sensitivity together with improved properties in use.

The materials described in the said document still exhibit an unsatisfactory graininess. It is accordingly the object of the present invention to remedy this defect.

This object is fulfilled by a colour photographic material possessing on a transparent support at least one silver halide emulsion layer unit which is sensitive to part of the visible spectrum and consists of at least the following constituent layers:

a) a spectrally sensitised silver halide emulsion layer containing an effective quantity of a FAR coupler and optionally a colour coupler, the latter during the colour development process coupling with a dye of which the colour is complementary to the spectral sensitisation of layer a), and b) a fine-grained silver halide emulsion layer having low sensitivity, of which the silver halide grains are not spectrally sensitised, being a layer adjacent to layer a), characterised in that layer b) contains a colour coupler which during the colour development process couples with a dye of which the colour is complementary to the spectral sensitisation of layer a) and the molar quantity of colour couplers in layer b) is greater than in layer a).

By "colour couplers" are meant exclusively colourless compounds of which the organic groups which may be released from the coupling position during coupling show no photographic activity. Colour couplers for the purpose of the invention are therefore in principle distinguished from all compounds such as DIR, DAR or FAR couplers in that they do not release compounds having photographic activity such as inhibitors, developer accelerators, fogging agents, et cetera.

In a preferred embodiment, layer a) contains no colour coupler.

If layer a) contains a colour coupler, the molar quantity of the latter is less than 10 mol.-% of the sum of the colour couplers in layers a) and b).

In another preferred embodiment, the silver halide emulsion of layer a) is sufficiently sensitive for a photographic material having total sensitivity ISO 400.

In a further preferred embodiment, the silver halide emulsion layer unit contains an additional layer c), which is identical in composition to layer b) and likewise is a layer adjacent to layer a).

Another preferred embodiment contains the additional layer d), which contains a silver halide emulsion sensitised for the same spectral range as is layer a) and at least one colour coupler, which during the colour development process couples with a dye which is complementary to the spectral sensitisation of this layer, the sensitivity being less than that of layer a).

Layers a) to d), viewed proceeding from the support, are preferably arranged in immediate succession in the following order: layer d), layer b), layer a), layer c). In another preferred embodiment, the material contains a red-sensitive silver halide emulsion layer unit to which cyan couplers are allocated, a green-sensitive silver halide emulsion layer unit to which magenta couplers are allocated and a blue-sensitive silver halide emulsion layer unit to which yellow couplers are allocated, with all the silver halide emulsion layer units containing at least one light-sensitive silver halide emulsion layer and with at least one silver halide emulsion layer unit being arranged in the manner according to the invention.

The FAR couplers used according to the invention preferably also couple with dyes of which the colour is complementary to the spectral sensitisation of the relevant silver halide emulsion layer unit.

Preferred FAR couplers correspond to the formula:

$$\text{COUP}-[\text{TIME}]_n-[\text{RED-LINK}]_m-\text{FG}$$

wherein

| | |
|---|---|
| COUP | denotes the group of a coupler, |
| RED-LINK | denotes a bonding component between COUP and FG, which is released from FG by reaction with an oxidised developer, |
| TIME | denotes a timing component, |
| FG | denotes a group producing a fogging nucleus and |
| n, m | denote 0, 1 or 2, in particular 0 or 1, and RED-LINK or TIME (when n equals 0 or m equals 0 respectively), and FG (when m and n equal 0), are bonded to the coupling position of COUP. |

All the coupler groups known in colour photography are suitable for use as the group COUP, for example, groups from yellow, magenta and cyan couplers.

The following are preferred bonding components RED-LINK

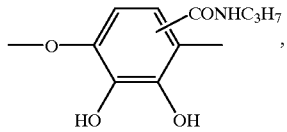

,

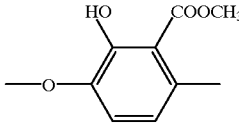

,

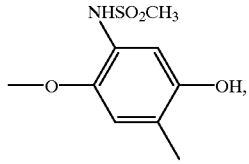

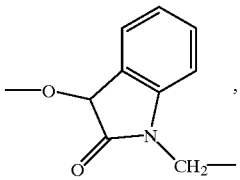

,

-continued

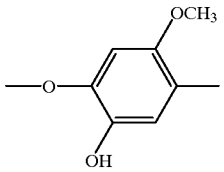

with the bond to COUP being effected via the oxygen atom.

The groups known from EP 438 150 are preferred timing components TIME, for example, the following groups:

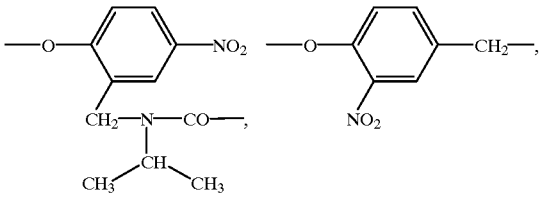

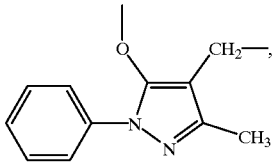

with the bond to COUP being effected via —O.

The following are preferred groups FG for producing fogging nuclei:

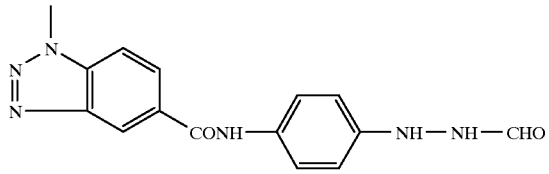

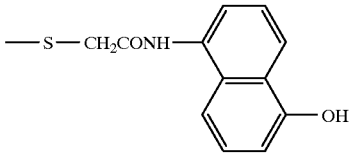

The FAR couplers are used particularly in a quantity of from 0.1 to 100 mg/m$^2$, preferably of from 1 to 10 mg/M$^2$ of the relevant layer.

The silver halide emulsions having low sensitivity, which are not spectrally sensitised and constitute layers b) and c), are in particular AgBr emulsions having an average particle diameter of $\leqq 0.30\ \mu$m. They may contain small proportions of iodide (up to 5 mol.-%), but are preferably free from iodide. They are incorporated in the respective layer in a quantity particularly of from 0.5 to 10 mmol/m$^2$.

Suitable FAR couplers are:

FAR-1

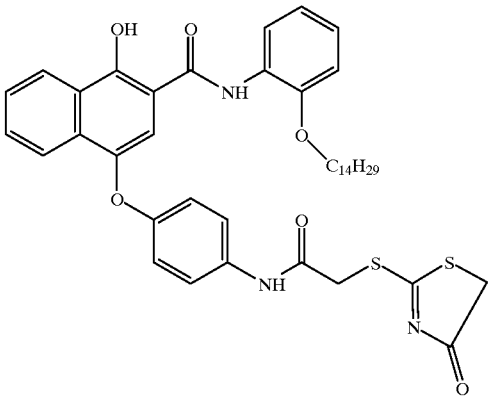

FAR-2

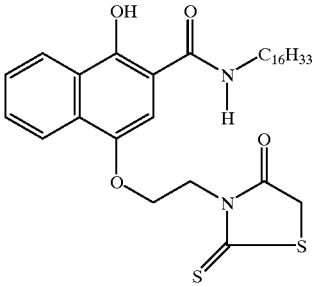

FAR-3

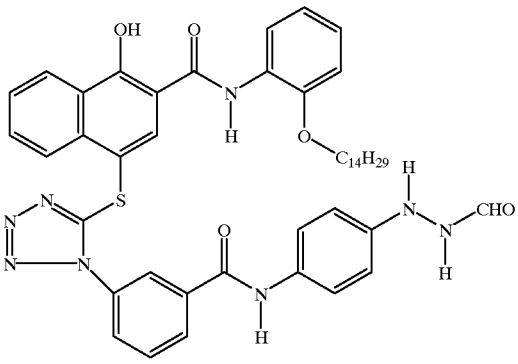

FAR-4

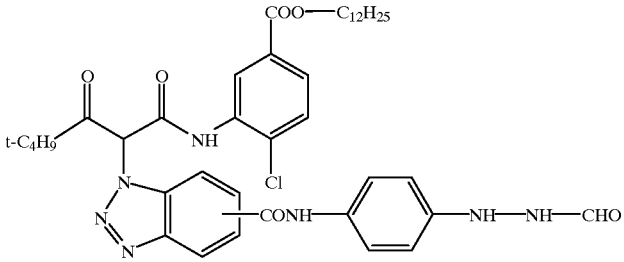

-continued

FAR-5

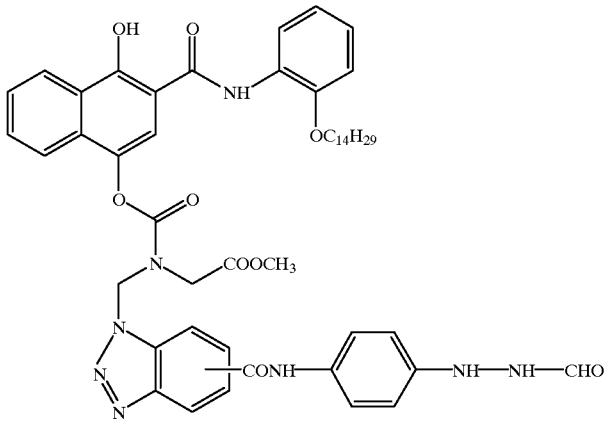

FAR-6

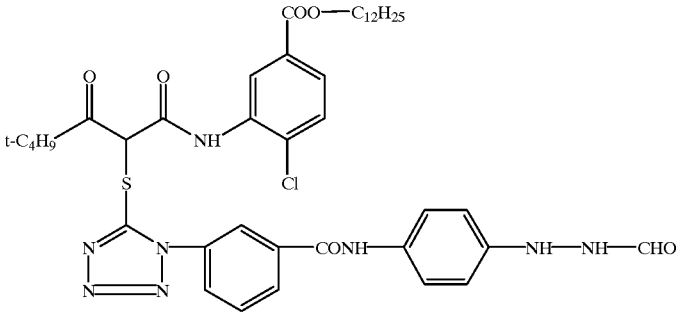

FAR-7

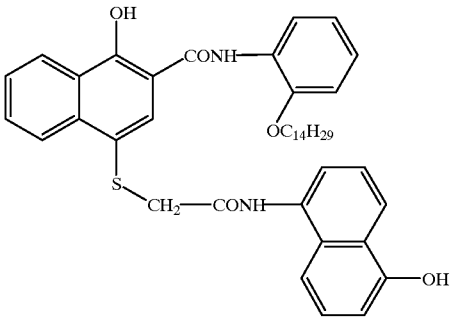

FAR-8

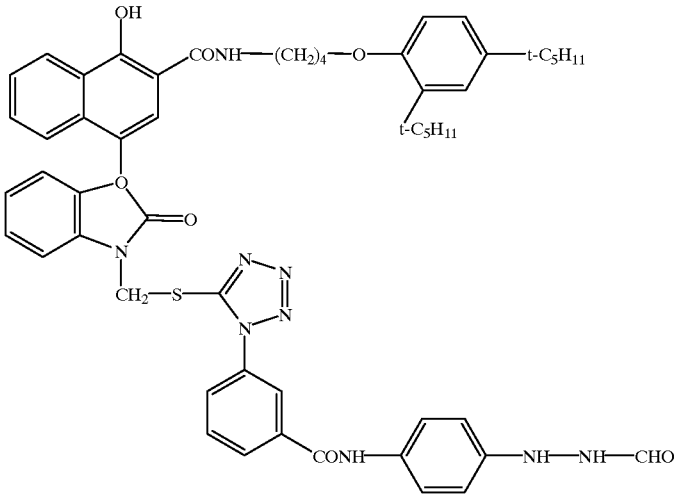

Examples of colour photographic materials having camera sensitivity are colour negative films and colour reversal films.

The photographic materials comprise a support, to which at least one light-sensitive silver halide emulsion layer is applied. Thin films and foils are particularly suitable as supports. A survey of support materials and of auxiliary layers applied to the front and reverse sides thereof is published in Research Disclosure 37254, Part 1 (1995), page 285.

In colour photographic films the support bears, generally in the following order, 2 or 3 red-sensitive silver halide emulsion layers which couple with cyan, 2 or 3 green-sensitive silver halide emulsion layers which couple with magenta and 2 or 3 blue-sensitive silver halide emulsion layers which couple with yellow. The layers having equal spectral sensitivity differ in their photographic sensitivity, with the constituent layers having lower sensitivity usually being arranged closer to the support than are the constituent layers having higher sensitivity.

A yellow filter layer, which prevents blue light from penetrating into the underlying layers, is usually placed between the green-sensitive and blue-sensitive layers.

The feasibility of different layer arrangements and their effects on the photographic properties are described in J. Inf. Rec. Mats., 1994, Vol. 22, pages 183–193.

The number and arrangement of the light-sensitive layers can be varied in order to achieve certain results. In order to increase the sensitivity, for example, all the highly sensitive layers in a photographic film can be combined to form a single pack and all the less sensitive layers can be combined to form another pack (DE 25 30 645).

Essential components of the photographic emulsion layers are binders, silver halide grains and colour couplers.

Information regarding suitable binders may be found in Research Disclosure 37254, Part 2 (1995), page 286.

Information regarding suitable silver halide emulsions, their preparation, ripening, stabilisation and spectral sensitisation including suitable spectral sensitisers may be found in Research Disclosure 37254, Part 3 (1995), page 286 and in Research Disclosure 37038, Part XV (1995), page 89.

Photographic materials having camera sensitivity generally contain silver bromide iodide emulsions, which optionally may also contain small quantities of silver chloride.

Information regarding the colour couplers may be found in Research Disclosure 37254, Part 4 (1995), page 288 and in Research Disclosure 37038, Part II (1995), page 80. The maximal absorption of the dyes formed from the couplers and the colour developer oxidation product is preferably within the following ranges: yellow coupler, 430 to 460 nm; magenta coupler, 540 to 560 nm; cyan coupler, 630 to 700 nm.

In colour photographic films, in order to improve sensitivity, graininess, sharpness and colour separation, compounds are frequently added which, in the course of the reaction with the developer oxidation product, release other compounds which are photographically active, for example, DIR couplers, which release a developer inhibitor.

Information on such compounds, in particular couplers, may be found in Research Disclosure 37254, Part 5 (1995), page 290 and in Research Disclosure 37038, Part XIV (1995), page 86.

Most hydrophobic colour couplers, and also other hydrophobic components of the layers, are generally dissolved or dispersed in high-boiling organic solvents. These solutions or dispersions are then emulsified in an aqueous binding agent (usually gelatine solution) and, after the layers have been dried, are present in the layers as fine droplets (0.05 to 0.8 $\mu$m in diameter).

Suitable high-boiling organic solvents, methods for introducing a photographic material into the layers and additional methods for introducing chemical compounds into photographic layers may be found in Research Disclosure 37254, Part 6 (1995), page 292.

The light-insensitive intermediate layers, which are usually arranged between layers having different spectral sensitivity, may contain agents which prevent an undesirable diffusion of developer oxidation products out of one light-sensitive layer into another light-sensitive layer having a different spectral sensitisation.

Suitable compounds (white couplers, scavengers or EOP traps) may be found in Research Disclosure 37254, Part 7 (1995), page 292 and in Research Disclosure 37038, Part III (1995), page 84.

The photographic material may also contain UV light-absorbing compounds, optical bleaches, spacers, filter dyes, formalin traps, light stabilisers, antioxidants, $D_{min}$ dyes, additives for improving the stability of the dyes, couplers and bleach as well as for lessening the colour fogging, plasticisers (latexes), biocides and other substances.

Suitable compounds may be found in Research Disclosure 37254, Part 8 (1995), page 292 and in Research Disclosure 37038, Parts IV, V, VI, VII, X, XI and XIII (1995), page 84 ff.

The layers of colour photographic materials are generally cured, that is, the binder used, preferably gelatine, is cross-linked by means of suitable chemical processes.

Suitable curing agents may be found in Research Disclosure 37254, Part 9 (1995), page 294 and in Research Disclosure 37038, Part XII (1995), page 86.

After imagewise exposure to light, colour photographic materials are processed by various methods appropriate to their nature. Details regarding the procedures and the chemicals required for them are published together with examples in Research Disclosure 37254, Part 10 (1995), page 294 and in Research Disclosure 37038, Parts XVI to XXIII (1995), page 95 ff.

EXAMPLES

Example 1

A colour photographic recording material for colour negative development was prepared (layer structure 1A), by applying the following layers in the specified order to a transparent layer support composed of cellulose triacetate. The quantities each refer to 1 $m^2$. For the silver halide coat, the corresponding quantities of $AgNO_3$ are given; the silver halides are stabilised using 0.5 g of 4-hydroxy-6-methyl-1, 3,3a,7-tetraazaindene per 100 g $AgNO_3$.

| | |
|---|---|
| | First layer (antihalo layer) |
| 0.3 g | black colloidal silver |
| 1.2 g | gelatine |
| 0.4 g | UV absorber UV-1 |
| 0.02 g | tricresyl phosphate |
| | Second layer (micrate intermediate layer) |
| 0.25 g | $AgNO_3$ of a micrate-Ag (Br, I) emulsion, average particle diameter 0.07 $\mu$m, 0.5 mol.-% of iodide |
| 1.0 g | gelatine |
| | Third layer (low red-sensitive layer) |
| 2.7 g | $AgNO_3$ of a spectrally red-sensitised Ag (Br, I) emulsion containing 4 mol.-% of iodide, average particle diameter 0.5 $\mu$m |
| 2.0 g | gelatine |
| 0.88 g | colour coupler C-1 |
| 0.02 g | DIR coupler D-1 |
| 0.05 g | coloured coupler RC-1 |
| 0.07 g | coloured coupler YC-1 |
| 0.75 g | tricresyl phosphate |
| | Fourth layer (high red-sensitive layer) |
| 2.2 g | $AgNO_3$ of a spectrally red-sensitised Ag (Br, I) emulsion, 12 mol.-% of iodide, average particle diameter 1.0 $\mu$m |
| 1.8 g | gelatine |
| 0.19 g | colour coupler C-2 |
| 0.17 g | tricresyl phosphate |
| | Fifth layer (intermediate layer) |
| 0.4 g | gelatine |
| 0.15 g | white coupler W-1 |
| 0.06 g | aluminium salt of aurintricarboxylic acid |
| | Sixth layer (low green-sensitive layer) |
| 1.3 g | $AgNO_3$ of a spectrally green-sensitised Ag (Br, I) emulsion, 4 mol.-% of iodide, average particle diameter 0.35 $\mu$m |
| 1.8 g | gelatine |
| 0.54 g | colour coupler M-1 |
| 0.24 g | DIR coupler D-1 |
| 0.065 g | coloured coupler YM-1 |
| 0.6 g | tricresyl phosphate |
| | Seventh layer (high green-sensitive layer) |
| 1.9 g | $AgNO_3$ of a spectrally green-sensitised Ag (Br, I) emulsion, 9 mol.-% of iodide, average particle diameter 0.8 $\mu$m |
| 1.1 g | gelatine |

-continued

| | |
|---|---|
| 0.195 g | colour coupler M-2 |
| 0.005 g | DIR coupler D-1 |
| 0.1 g | white coupler W-1 |
| 0.05 g | coloured coupler YM-2 |
| 0.25 g | tricresyl phosphate |

Eighth layer (yellow filter layer)

| | |
|---|---|
| 0.09 g | yellow colloidal silver |
| 0.25 g | gelatine |
| 0.08 g | scavenger SC-1 |
| 0.40 g | formaldehyde trap FF-1 |
| 0.08 g | tricresyl phosphate |

Ninth layer (low blue-sensitive layer)

| | |
|---|---|
| 0.9 g | of a spectrally blue-sensitised Ag (Br, I) emulsion, 6 mol.-% of iodide, average particle diameter 0.6 $\mu$m |
| 2.2 g | gelatine |
| 1.1 g | colour coupler Y-1 |
| 0.037 g | DIR coupler D-1 |
| 1.14 g | tricresyl phosphate |

Tenth layer (high blue-sensitive layer)

| | |
|---|---|
| 0.6 g | $AgNO_3$ of a spectrally blue-sensitised Ag (Br, I) emulsion, 10 mol.-% of iodide, average particle diameter 1.2 $\mu$m |
| 0.6 g | gelatine |
| 0.2 g | colour coupler Y-1 |

-continued

| | |
|---|---|
| 0.003 g | DIR coupler D-1 |
| 0.22 g | tricresyl phosphate |

Eleventh layer (micrate layer)

| | |
|---|---|
| 0.06 g | $AgNO_3$ of a micrate-Ag (Br, I) emulsion, average particle diameter 0.06 $\mu$m, 0.5 mol.-% of iodide |
| 1 g | gelatine |
| 0.3 g | UV absorber UV-2 |
| 0.3 g | tricresyl phosphate |

Twelfth layer (protective and curing layer)

| | |
|---|---|
| 0.25 g | gelatine |
| 0.75 g | curing agent corresponding to the formula |

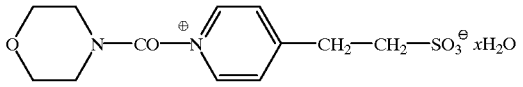

so that the total layer structure after curing had a swelling factor of ≦3.5.

Substances used in Example 1:

UV-1

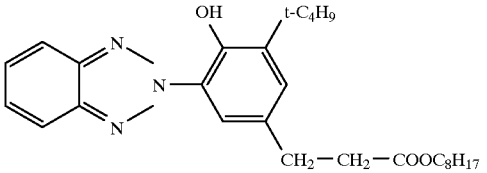

UV-2

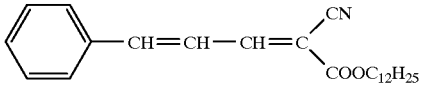

C-1

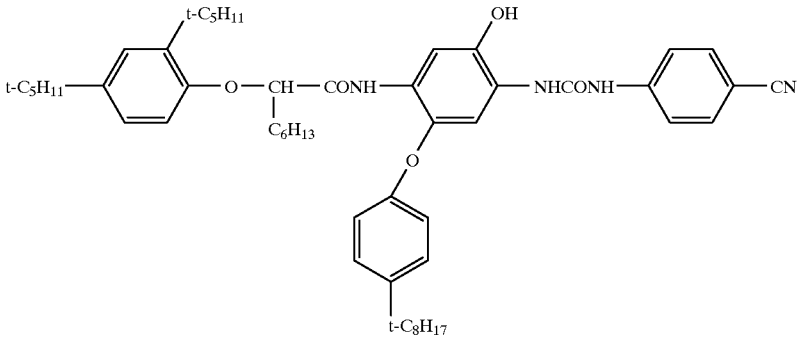

C-2

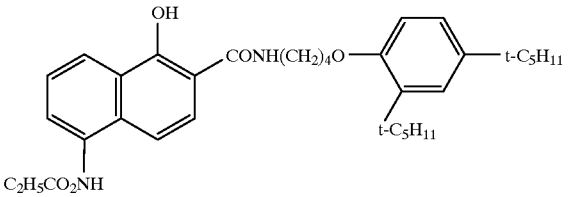

-continued
RC-1
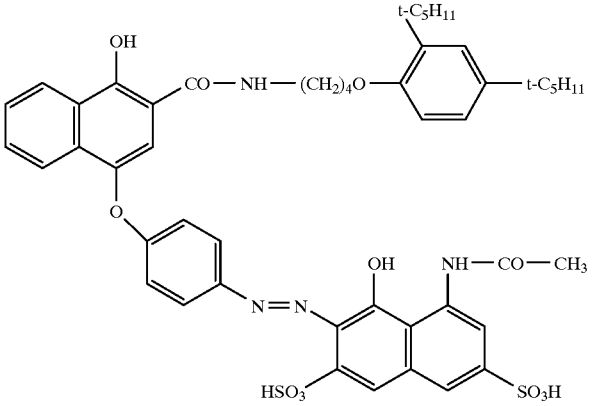
M-1
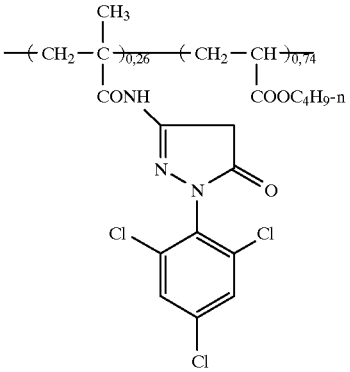
M-2
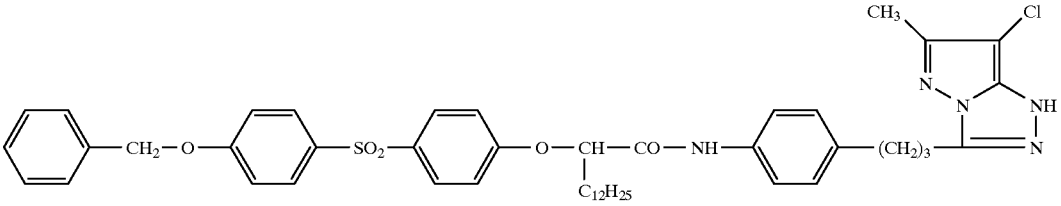
YM-1
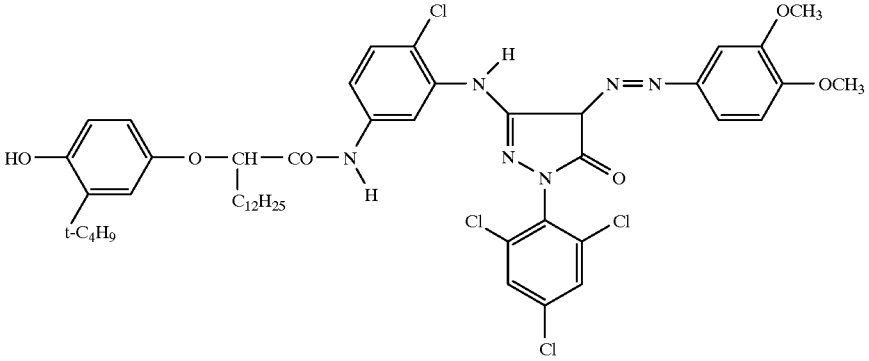
Y-1
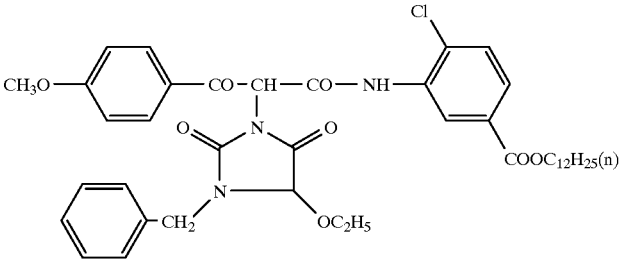
D-1
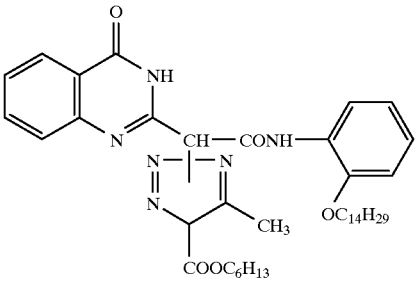

-continued

YC-1

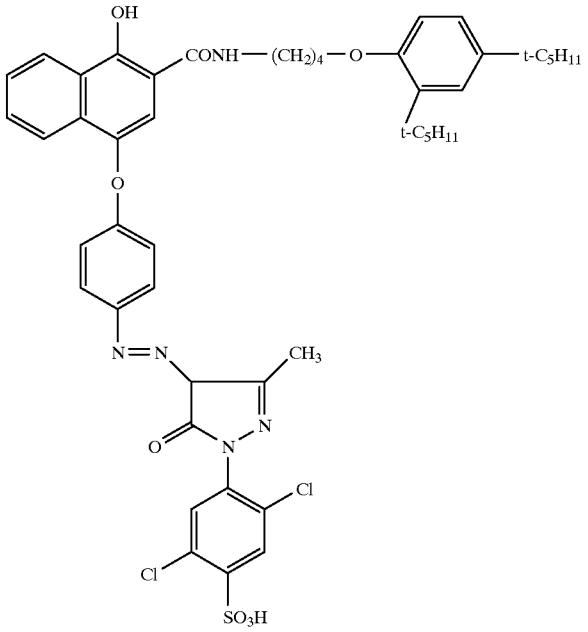

YM-2

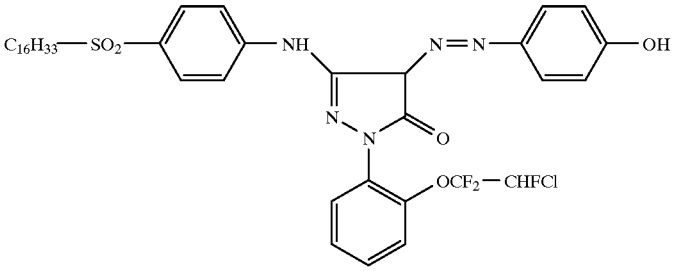

SC-1

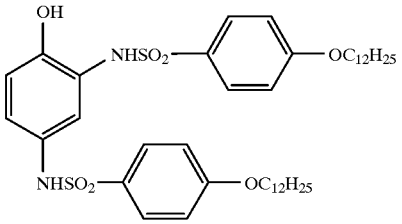

FF-1

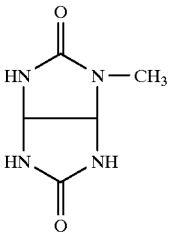

W-1

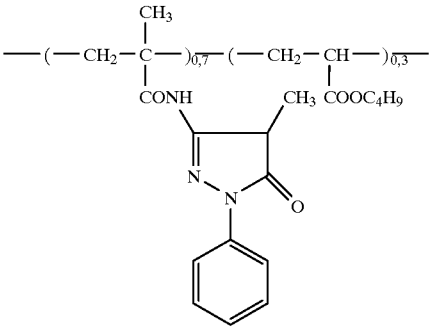

After exposing a neutral wedge filter, the development is carried out as described in "The British Journal of Photography", 1974, pages 597 and 598.

In the layer structures 1B and 1C the seventh layer was replaced by the layers 7a, 7b and 7c listed below. Here 7a is adjacent to the sixth layer and 7c is adjacent to the eighth layer.

Layer structure 1B (Comparison)

Layer 7a (intermediate layer)

| | |
|---|---|
| 0.5 g | $AgNO_3$ of an AgBrCl emulsion, 20 mol.-% of bromide, not spectrally sensitised, average particle diameter 0.32 $\mu$m |
| 1.0 g | gelatine |

Layer 7b (high green-sensitive layer)

| | |
|---|---|
| 1.4 g | $AgNO_3$ of a spectrally green-sensitised Ag (Br, I) emulsion, 9 mol.-% of iodide, average particle diameter 0.8 $\mu$m |

-continued

| | |
|---|---|
| 1.3 g | gelatine |
| 0.195 g | colour coupler M-2 |
| 0.05 g | coloured coupler YM-2 |
| 0.005 g | DIR coupler D-1 |
| 0.1 g | white coupler W-1 |
| 0.25 g | tricresyl phosphate |
| 0.003 g | FAR coupler FAR-4 |
| | Layer 7c (intermediate layer) |
| 0.5 g | $AgNO_3$ of an AgBrCl emulsion, 20 mol.-% of bromide, not spectrally sensitised, average particle diameter 0.32 μm |
| 1.0 g | gelatine |
| | Layer structure 1C (according to the invention) |
| | Layer 7a (coupler-containing layer) |
| 0.4 g | $AgNO_3$ of an unripened, not spectrally sensitised AgBr emulsion, average particle diameter 0.25 μm |
| 0.8 g | gelatine |
| 0.11 g | colourless coupler M-2 |
| 0.03 g | coloured coupler YM-2 |
| 0.14 g | tricresyl phosphate |
| | Layer 7b (high green-sensitive layer) |
| 1.1 g | $AgNO_3$ of a spectrally green-sensitised Ag (Br, I) emulsion, 9 mol.-% of iodide, average particle diameter 0.8 μm |
| 1.05 g | gelatine |
| 0.1 g | white coupler W-1 |
| 0.005 g | DIR coupler D-1 |
| 0.005 g | FAR coupler FAR-4 |
| 0.210 g | tricresyl phosphate |
| | Layer 7c (coupler-containing layer) |
| 0.4 g | $AgNO_3$ of an unripened, not spectrally sensitised AgBr emulsion, average particle diameter 0.25 μm |
| 0.8 g | gelatine |
| 0.11 g | colourless coupler M-2 |
| 0.03 g | coloured coupler YM-2 |
| 0.14 g | tricresyl phosphate |

After exposure and development the following values were obtained:

| Example | Sensitivity (mg) | Fogging (mg) | Gradation (mg) | RMS graininess (mg) |
|---|---|---|---|---|
| A | 100 | 0.58 | 0.67 | 16 |
| B | 113 | 0.84 | 0.53 | 22 |
| C | 120 | 0.55 | 0.70 | 14 |

Surprisingly, the graininess in the embodiment C according to the invention compared with prior art is the lowest, accompanied by a distinctly increased sensitivity. "mg" stands for "magenta".

We claim:

1. A color photographic recording material having camera sensitivity, which comprises on a transparent support at least one silver halide emulsion layer unit which is sensitive to part of the visible spectrum and consists essentially of at least the following constituent layers:

a) a spectrally sensitized silver halide emulsion layer containing an effective quantity of an FAR coupler (coupler, which during coupling releases groups producing fogging nuclei) and optionally a color coupler, the latter during the color development process coupling to a dye of which the color is complementary to the spectral sensitization of layer a), and b) a fine-grained silver halide emulsion layer having low light-sensitivity, of which the silver halide grains are not spectrally sensitized and being a layer adjacent to layer a), wherein said layer b) contains a color coupler which during the color development process couples to a dye of which the color is complementary to the spectral sensitization of layer a) and the molar quantity of color couplers in layer b) is greater than in layer a).

2. The color photographic recording material according to claim 1, wherein layer a) contains no color coupler.

3. The color photographic recording material according to claim 1, wherein the silver halide emulsion layer unit contains an additional layer c) which is identical in composition to layer b) and likewise is a layer adjacent to layer a).

4. The color photographic recording material according to claim 3, wherein the silver halide emulsion layer unit contains an additional layer d), which contains a silver halide emulsion that is sensitized for the same spectral range as is layer a) and in comparison with layer a) is less sensitive, and a color coupler, which during the color development process couples to a dye which is complementary to the spectral sensitization of layer d).

5. The color photographic recording material according to claim 4, wherein said layers a) to d), viewed proceeding from the support, are arranged in immediate succession in the following order; layer d), layer b), layer a), layer c).

6. The color photographic recording material according to claim 1, wherein the FAR coupler corresponds to the formula $$\text{COUP}-[\text{TIME}]_n-[\text{RED-LINK}]_m-\text{FG}$$

wherein

| | |
|---|---|
| COUP | denotes the group of a coupler, |
| RED-LINK | denotes a bonding component between COUP and FG, which is released from FG by reaction with an oxidized developer, |
| TIME | denotes a timing component, |
| FG | denotes a group producing a fogging nucleus and |
| n and m | are identical or different and are 0, 1 or 2, and RED-LINK or TIME (when n equals 0 or m equals 0 respectively, and FG (when m and n equal 0), are bonded to the coupling position of COUP. |

7. The color photographic recording material according to claim 1, wherein the FAR coupler is used in a quantity of from 0.1 to 100 $mg/m^2$.

8. The color photographic recording material according to claim 6, wherein n and m are identical or different and are 0 or 1.

9. The color photographic recording material according to claim 6, wherein RED-LINK is

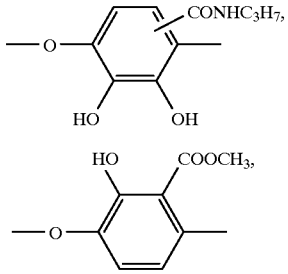

-continued
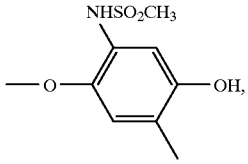
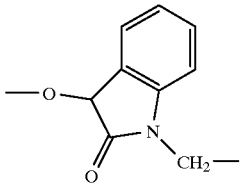
, or
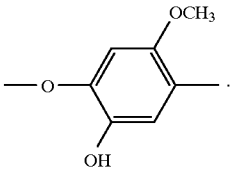
.
10.The color photographic recording material according to claim 9, wherein TIME is
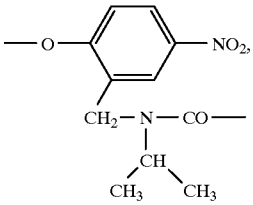
-continued
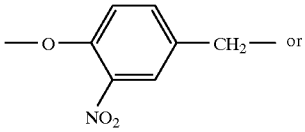
or
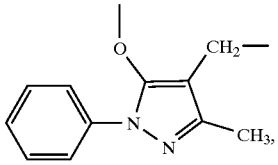
with the bond to COUP being effected via —O.
11. The color photographic recording material according to claim 10, wherein FG is
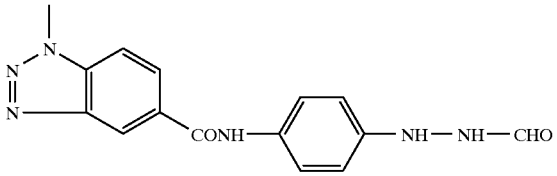
or
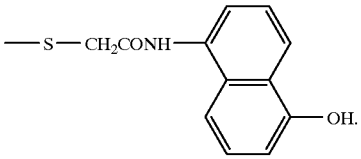
12. The color photographic material according to claim 6, wherein the FAR coupler is
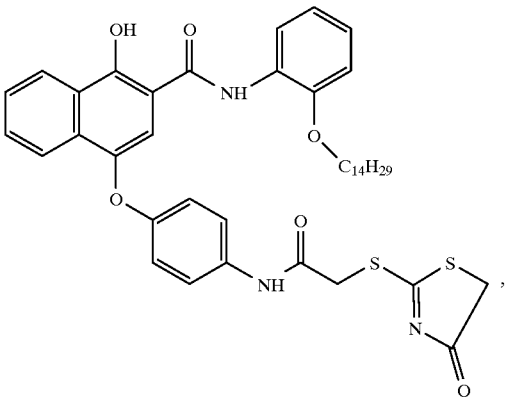

-continued
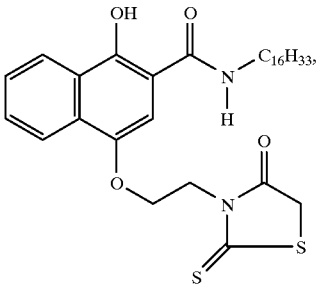
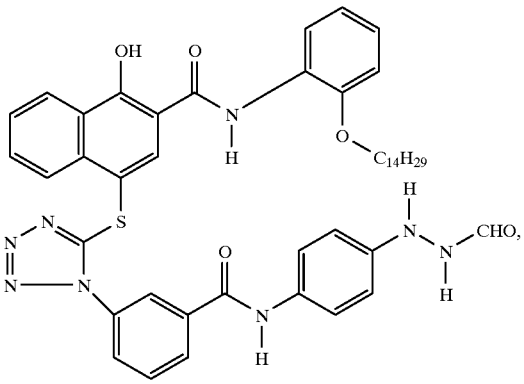
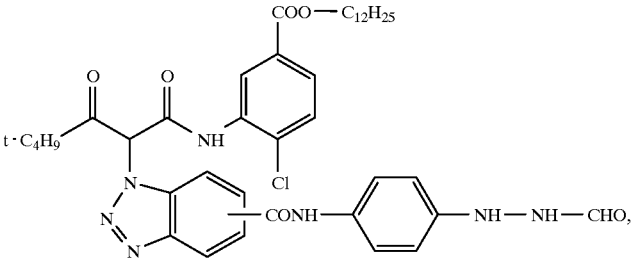
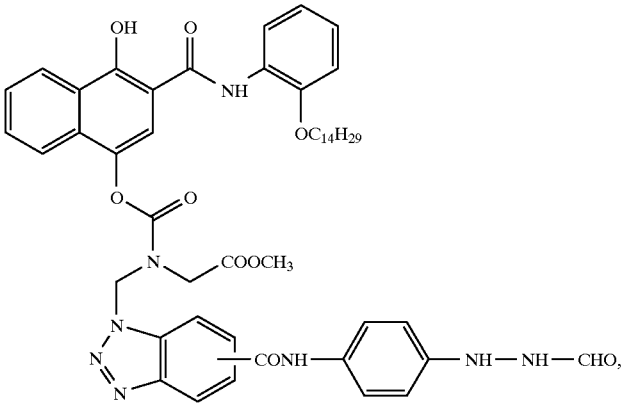

-continued
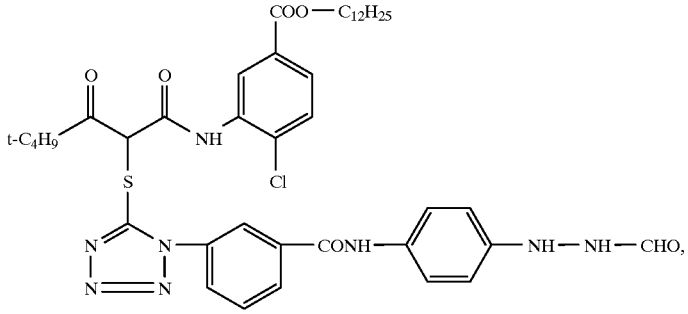
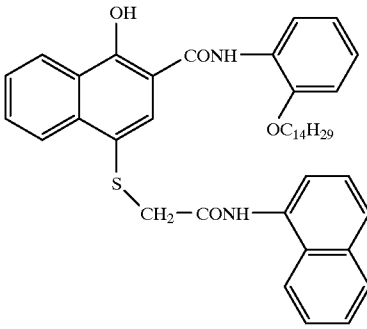
or
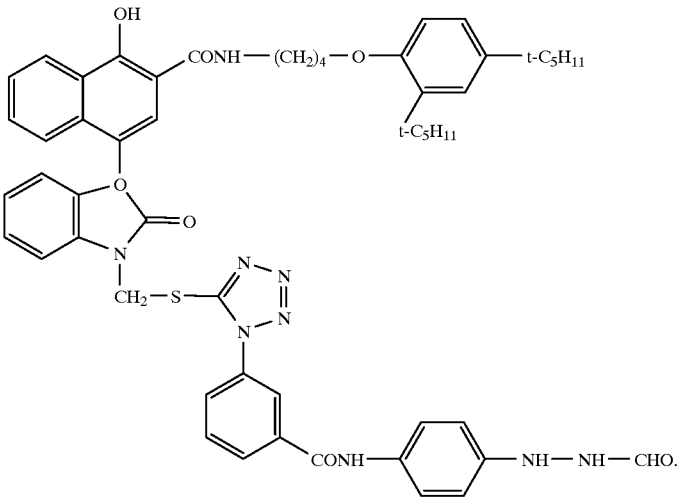
* * * * *